United States Patent [19]

Kawakami

[11] Patent Number: 4,832,515

[45] Date of Patent: May 23, 1989

[54] PRINTING HEAD FOR A WIRE DOT-MATRIX PRINTER

[75] Inventor: Yoshiyuki Kawakami, Tokyo, Japan

[73] Assignee: Kabushiki Kaisha Toshiba, Kawasaki, Japan

[21] Appl. No.: 76,761

[22] Filed: Jul. 23, 1987

[30] Foreign Application Priority Data

Jul. 28, 1986 [JP] Japan ..... 61-114604[U]

[51] Int. Cl.[4] ..... B41J 3/12

[52] U.S. Cl. ..... 400/124; 101/93.05

[58] Field of Search ..... 400/124; 101/93.05; 335/271, 277

[56] References Cited

U.S. PATENT DOCUMENTS

| | | | |
|---|---|---|---|
| 3,828,908 | 8/1974 | Schneider | 197/1 R |
| 3,929,214 | 12/1975 | Hebert | 197/1 R |
| 4,009,772 | 3/1977 | Glaser et al. | 197/1 R |
| 4,060,161 | 11/1977 | Nelson et al. | 197/1 R |
| 4,230,038 | 10/1980 | Hebert | 101/93.05 |
| 4,230,412 | 10/1980 | Hebert | 400/124 |
| 4,411,538 | 10/1983 | Asano | 400/124 |
| 4,555,192 | 11/1985 | Ochiai | 400/124 |
| 4,594,010 | 6/1986 | Jachno | 400/124 |
| 4,624,589 | 11/1986 | Ochiai | 400/124 |
| 4,661,002 | 4/1987 | Ara | 400/124 |

*Primary Examiner*—Paul T. Sewell

*Attorney, Agent, or Firm*—Finnegan, Henderson, Farabow, Garrett & Dunner

[57] ABSTRACT

A printing head includes a core section and a housing section coupled thereto. The core section has a core having a plurality of pole portions around which coils are wound. The core is arranged in the case and coupled therewith by means of an insulating resin filling a gap between the core and the case. A stopper is located in the case. The housing section includes a plurality of armatures and printing wires extending from the corresponding armatures. Each armature has an intermediate portion abutting the core, one end portion facing the stopper, and the other end facing the corresponding pole portion, and is rockable around the intermediate portion. The armature is urged by an urging member to an initial position where the one end portion abuts the stopper. When selected coils are energized, the other end portions of the corresponding armatures are attracted to the pole portions, so that the armatures are rocked to a printing position where the one end portion is spaced from the stopper. In accordance with the rocking of the armature, the printing wire moves axially.

7 Claims, 4 Drawing Sheets

PRINTING HEAD FOR A WIRE DOT-MATRIX PRINTER

BACKGROUND OF THE INVENTION

The present invention relates to a printing head and, more particularly, to a printing head used in a wire dot-matrix printer.

A printing head of this type generally comprises a housing section and a core section, which are fastened together by screws. The housing section includes a housing and an armature guide fixed thereto. A number of armatures are supported by the armature guide, and a stopper is mounted on the guide, so as to face the armatures. Printing wires protrude individually from the armatures, so that their distal ends are arranged in two lines. The housing is provided with springs which urge the armatures toward the stopper.

The core section includes a plurality of cores, equal in number to the armatures, a plurality of coils wound individually around the cores, and a circuit board for controlling the current supplied to the coils. These elements of the core section are housed in a case. When the core section is coupled to the housing section, the armatures face their corresponding cores, and are partially pressed against the cores by a press ring in the housing section. Thus, each armature is rockable around the point of contact with its corresponding core. As the armatures rock in this manner, their corresponding printing wires reciprocate axially.

When, in printing operation, selected coils are energized by means of the circuit board, a magnetic flux is produced in their corresponding cores. The armatures corresponding to these cores are attracted thereto by the magnetic flux. Thus, the armatures rock toward the cores, against the urging force of their corresponding springs, so that the printing wires project from the housing, thereby effecting the desired printing on recording paper. When the coils are deenergized, the armatures are urged by the springs to rock to their initial position where they abut against the stopper. Thereupon, the printing wires are disengaged from the recording paper.

Being constructed in this manner, however, the aforementioned conventional printing head has the following drawbacks:

In the course of returning to the initial position, urged by the springs, the armatures normally strike against the stopper, thereby subjecting the stopper to a considerable impact. Since the stopper is attached to the armature guide, such an impact acts also on the guide. Therefore, the guide must be sufficiently sturdy to withstand the impact. Thus, the armature guide and hence, the printing head, cannot easily be made compact. Since the stopper has its end portions supported by the armature guide, moreover, it is liable to vibrate heavily, thereby producing noise, when subjected to the aforesaid impact. The rocking angle of the armatures, which determines the stroke of the printing wires, depends on the relative positions of the stopper and those portions of the cores in contact with the armatures. In the case of the printing head constructed in this manner, the cores and the stopper are provided at different parts of the head, that is, the core section and the housing section, respectively. It is therefore difficult to achieve the desired positional relationship between the cores and the stopper with a sufficiently high degree accuracy, or to accurately determined the stroke of the printing wires. While the printing head is operating, furthermore, the cores produce heat, which is transmitted to the stopper through the armature guide and the armatures. Having the aforementioned construction, however, the stopper has a low effeciency of heat radiation; consequently, it may possibly be deformed by the heat. If the stopper is deformed in this manner, then the armatures cannot be positioned satisfactorily, and accurate printing operation cannot be accomplished with ease.

SUMMARY OF THE INVENTION

The present invention has been conceived in consideration of these circumstances, and has an object to provide a printing head capable of miniaturization, in which the stroke of printing wires can be determined accurately, and a stopper can be prevented from vibrating and from being deformed.

In order to achieve the above object, a printing head according to the present invention is designed so that a stopper, against which armatures are to strike, is provided at a core section.

BRIEF DESCRIPTION OF THE DRAWINGS

FIGS. 1 to 3 show a printing head according to a first embodimnt of the present invention, in which FIG. 1 is an exploded perspective view of the head, FIG. 2 is a longitudinal sectional view of the head, and FIG. 3 is a longitudinal sectional view of the head in an operating state different from the state shown in FIG. 2.

DETAILED DESCRIPTION OF THE PREFERRED EMBODIMENTS

Preferred embodiments of the present invention will now be described in detail with reference to the accompanying drawings.

Figure 1:
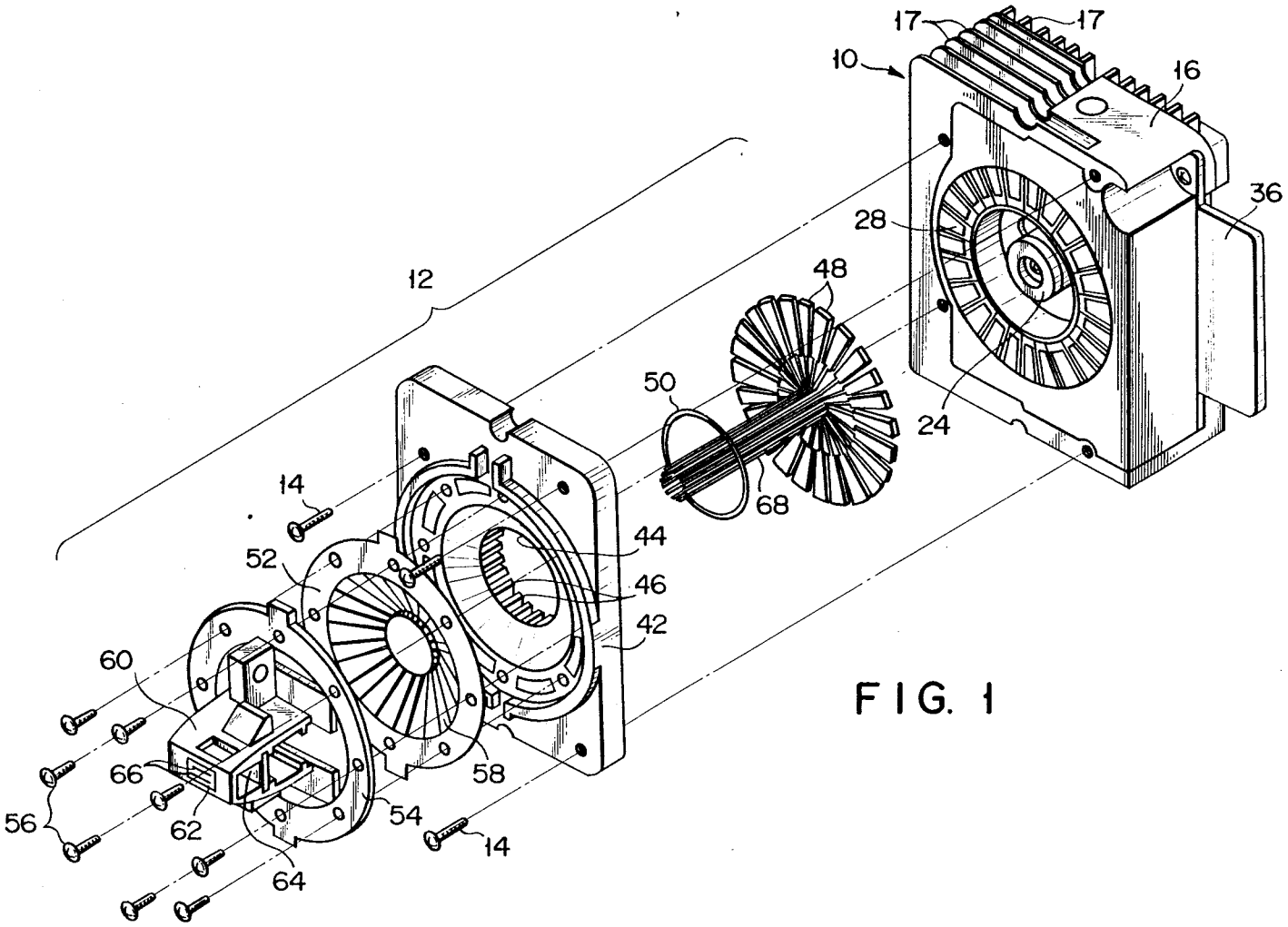
Figure 2:
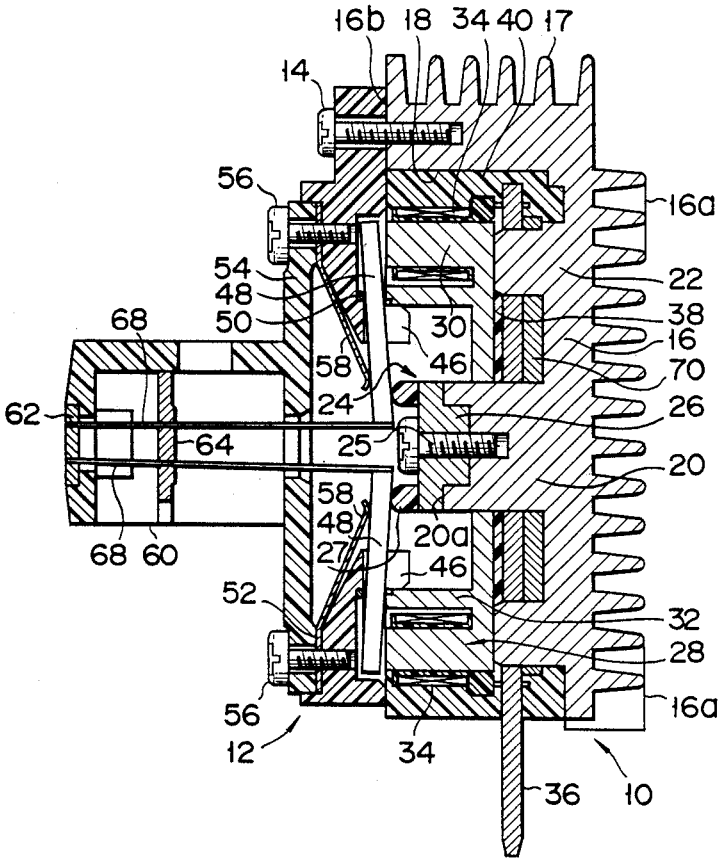

As shown in FIGS. 1 and 2, a printing head comprises core section 10 and housing section 12, which are screwed to each other by means of screws 14.

Core section 10 includes substantially rectangular case 16. Cooling fins 17 are formed on the outer surface of case 16. Also, recess 18 is formed in case 16. Case 16 has first projection 20 and a plurality of second projections 22, protruding from the bottom of recess 18. First projection 20 is situated in the center of recess 18, while second projections 22 are arranged around projection 20, at intervals in the circumferential direction. Stopper 24 is attached to end face **20*a* of projection 20 by means of screw 25. The stopper includes disk-shaped base 26, intimately in contact with end face 20*a*, and rubber ring 27 fixed to the base by baking. Ring 27**, which must only be formed of an elastic member, may be made of synthetic resin as well as rubber.

Ring-shaped core 28 is arranged in recess 18 of case 16, surrounding stopper 24 coaxially. Core 28 includes a number of outer pole portions 30, e.g., 24 pole portions, arranged in a ring at predetermined intervals, and annular inner pole portion 32 situated inside the cores. Each pole portion 30 has a trapezoid cross section. Each pole portion 30 is wound with coil 34 for generating magnetic flux therein. Core 28 is housed in recess 18 of case 16 in a manner such that it abuts aginst the respective end faces of second projections 22. Printed circuit board 36 is located at the bottom of recess 18. One end portion of board 36 projects to the outside of case 16. Coils 34 are electrically connected to board 36, which feeds the desired coils with electric power supplied from a power source (not shown). Spacer 38 for insulation is interposed between printed circuit board 36 and core 28. Insulating resin 40, such as an epoxy or polycarbonate, fills spaces between the outer periphery of core 28 and the inner surface of recess 18. Insulating spacer 70 is interposed between board 36 and the bottom of recess 18.

Housing section 12 includes rectangular armature guide 42, which is screwed to the top surface of case 16 by means of screws 14. Aperture 44 is bored through the center of guide 42 so as to be coaxial with stopper 24 and core 28. A number of guide protrusions 46 are formed on the case-side surface of guide 42, so as to be spaced along the circumference of aperature 44. Plate-shaped armature 48 is located between each two adjacent protrusions 46. Thus, 24 armatures 48 are arranged extending radially, so that their inner end portions face stopper 24, and their outer end portions face their corresponding pole portions 30. Press ring 50 is interposed between armatures 48 and armature guide 42. The middle portion of each armature 48 is pressed against the end edge of inner pole portion 32 of core 28 by ring 50. Thus, each armature 48 can rock around its middle portion, between an initial position (FIG. 2), where its inner end portion engages stopper 24, and a printing position (FIG. 3) where its outer end portion is close to its coresponding pole portion 30.

Disk plate 52, made of metal, and housing 54 are screwed successively to that surface of armature guide 42 opposite to case 16, by means of screws 56. A number of radial slits are cut in the central portion of plate 52, which is bent on the side of case 16, thus forming 24 leaf springs 58. Springs 58 penetrate aperture 44 of guide 42, and abut against the inner end portions of their corresponding armatures 48. Thus, armatures 48 are urged and kept in the initial position by springs 58. Housing 54 has hollow nose portion 60 which protrudes coaxially with aperture 44 of armature guide 42. End guide plate 62 and intermediate guide plate 64 are attached, in parallel relation, to the projecting end and the intermediate portion, respectively, of nose portion 60. guide plate 62 is formed with a number of guide holes drawn up in two parallel lines, while guide plate 64 has a pair of slits (not shown).

Printing wire 68 is fixed to the inner end of each armature 48. It extends from the armature to the distal end of nose portion 60, through aperture 44 and the inside of the nose portion. While passing through nose portion 60, wires 68 are redirected by the slits and guide holes 66 of guide plates 64 and 62, and the respective distal ends of the wires are arranged in two lines. In this arrangement, each wire 68 is reciprocated in the axial direction as its corresponding armature 48 is rocked. The ends of printing wires 68 are situated on the same plane with the end guide plate 62 when armatures 48 are in the initial position. When the armature are situated in the printing position, their coresponding wires project about 0.3 mm from plate 62.

The operation of the printing head with the aforementioned construction will now be described.

Figure 3:
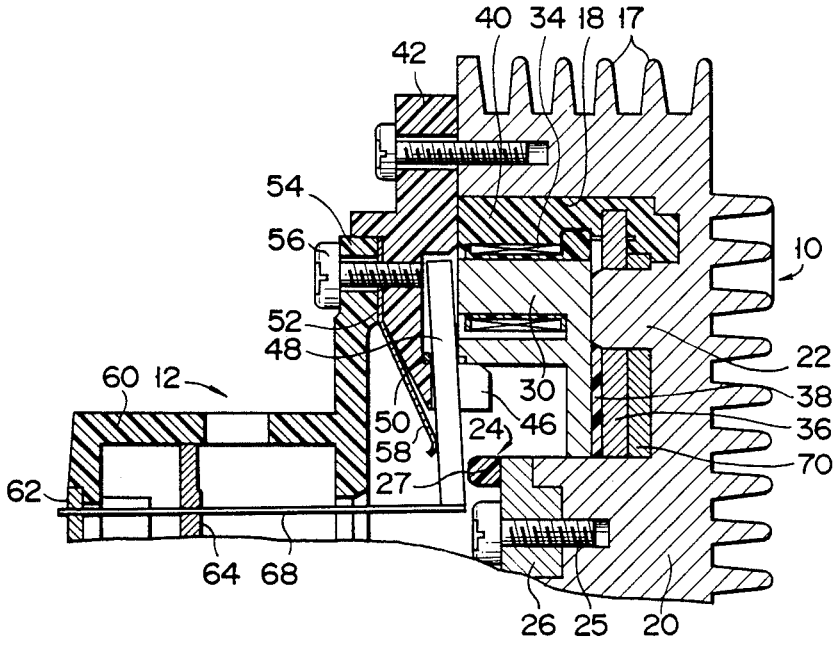

Normally, armatures 48 are urged, by their corresponding springs 58, to be kept in the initial position where their inner end portions abut against rubber ring 27 of stopper 24. In this state, none of the distal ends of printing wires 68 project from end guide plate 62. When desired coils 34 are energized through printed circuit board 36, magnetic flux is produced in their corresponding pole portions 30. Thereupon, the outer end portions of those armatures 48 which face these pole portions 30 are attracted thereto, to be rocked to the printing position, as shown in FIG. 3. As armatures 48 rock in this manner, printing wires 68 move to the left of FIG. 3, so that their distal ends project over a predetermined distance from guide plate 62. By doing this, the ends of wires 68 strike against, e.g., an ink ribbon on a recording sheet (not shown) to effect printing thereon. When coils 34 are deenergized, armatures 48 are returned to the initial position by springs 58. Thereupon, the ends of printing wires 68 are disengaged from the recording sheet.

The initial position of armatures 48 and the stroke or the length of projection of printing wires 68 are determined by the location of stopper 24.

In assembling the printing head described above, stopper 24 and core 28 are aligned in the following steps of procedure.

First, end face **20*a* of projection 20 is worked with use of bottom surface 16*a* of case 16 as a datum plane, thereby adjusting the height of projection 20 to a predetermined value. Then, core 28, spacer 38, printed board 36, and spacer 70 are put into recess 18 of case 16, and fixed by means of resin 40. Thereafter, core 28 and end face 16*b* of case 16 are simultaneously worked and adjusted to a predetermined height, with use of bottom surface 16*a* of case 16 as a datum. Thus, the position of pole portion 32, which serves as a pivotal point for each armature 48, and the position of stopper 24**, on which the initial position of the armatures depends, are determined accurately.

Constructed in this manner, the printing head of the present invention has the following advantages.

Since stopper 24 and core 28 are mounted on the same member, i.e., case 16, their respective positions can be adjusted accurately. Therefore, the rocking angle of armatures 48 and the stroke of printing wires 68, which depend on the relative positions of stopper 24 and core 28, can be determined accurately with ease. Moreover, stopper 24 is fixed to case 16 which has substantial mass and strength. Further, case 16 is coupled with core 28 of a great mass by means of resin 40. Thus, case 16 and core 28 having substantial mass can absorb an impact which is produced when armatures 48 strike against stopper 24 as they return from the printing position to the initial position. Accordingly, vibration of stopper 24 can be prevented, so that the noise level can be lowered. Since the aforesaid impact can hardly be transmitted to armature guide 42 of housing section 12, guide 42 need not be made very strong. In consequence, guide 42 can enjoy a thinner and smaller structure, thus permitting miniaturization of the printing head as a whole.

Heat produced from coils 34 and core 28, during the printing operation, is transmitted to stopper 24 through case 16, armatures 48, etc. However, stopper 24 is fixed to case 16 which, made of metal, has a wide area of contact with the outside air, and therefore, enjoys a high efficiency of heat radiation. Accordingly, heat from stopper 24 can be radiated satisfactorily through case 16. Also, the heat from coils 34 and core 28 can be discharged from case 16 to the outside before it reaches stopper 24, after passing through the case. Thus, stopper 24 cannot be deformed by too much heat, so that armatures 48 can be positioned with high accuracy.

Since resin 40 is filled in the gap between case 16 and core 28, heat can be radiated from core 28 and coils 34 to case 16 with a higher efficiency than in the case where no resin is filled in the gap. In addition, since resin 40 is electrically insulative, the dielectric strength between case 16 and coils 34 increases, thereby enhancing the reliability of the printing head.

It is to be understood that the present invention is not limited to the embodiment described above, and that various changes and modifications may be effected therein by one skilled in the art without departing from the scope or spirit of the invention.

Figure 4:
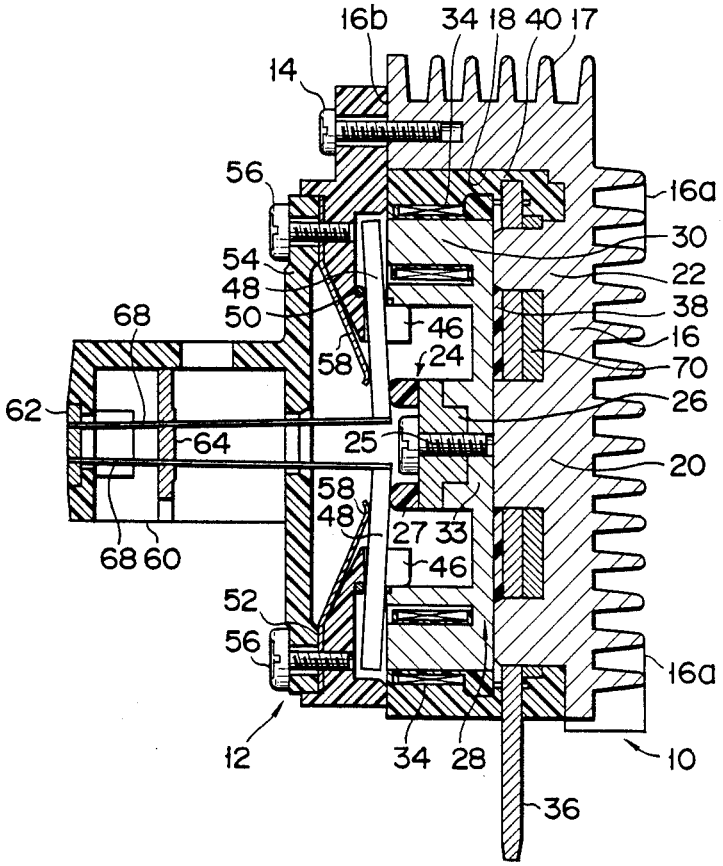
FIG. 4 is a longitudinal sectional view of a printing head according to a second embodiment of the invention.

As shown in FIG. 4, for example, core 28 may alternatively include bottom wall 33 which abuts against projection 20 of case 16. Stopper 24 can be directly screwed to bottom wall 33 of core 28 by means of screw 25. As regards other arrangements, this second embodiment is substantially the same as the first embodiment. In the drawings of FIGS. 1 to 4, therefore, like reference numerals refer to the same parts throughout the several views.

Constructed in this manner, the second embodiment can provide the same functions and effects of the first embodiment.

What is claimed is:

1. A printing head comprising:

(A) a core section including:

a case having a recess and a projection protruding from the bottom of the recess, the projection having a distal end face;

a core having a plurality of pole portions and housed in the recess, the core being fixed to the case, a plurality of coils wound around the pole portions, to produce magnetic flux in the pole portions, and a stopper housed in the recess and fixed to the distal end face of the projection, the stopper being located at a predetermined position relative to the core; and (B) a housing section coupled to the core section, said housing section including:

an armature guide, a plurality of armatures guided by the armature guide and positioned close to the pole portions corresponding thereto, each armature having an intermediate portion abutting against the core, one end portion facing the stopper, and the other end portion facing the corresponding pole portion, said armature being supported by the armature guide so as to be rockable around the intermediate portion, between an initial position, where said one end portion abuts against the stopper, and a printing position, where said one end portion is spaced apart from the stopper, a plurality of printing wires protruding individually from the armatures, and adapted to move axially when the corresponding armatures rock, and urging means for urging the armature toward the initial position.

2. The printing head according to claim 1, wherein said pole portions are arranged at regular intervals outside the stopper and along the circumference of a circle concentric with the stopper.

3. The printing head according to claim 1, wherein said stopper includes a base fixed to the distal end face of the projection, and a ring-shaped elastic member coaxial with the pole portions and fixed to the base.

4. The printing head according to claim 2, wherein said core includes an annular inner pole portion located inside the pole portions so as to be coaxial therewith, said inner pole portion having an edge abutting against the respecive intermediate portions of the armatures.

5. The printing head according to claim 2, wherein said armatures are arranged extending radially with respect to the axis of the core.

6. The printing head according to claim 1, wherein said core is housed in the case with a gap therebetween, the gap being filled with an insulating resin.

7. The printing head according to claim 1, wherein said core section includes a printed circuit board arranged in the case and electrically connected to the coils, for energizing selected coils.

* * * * *